United States Patent [19]

Joelsson et al.

[11] Patent Number: 4,990,733

[45] Date of Patent: Feb. 5, 1991

[54] MICROWAVE OVEN WITH IMPROVED MICROWAVE POWER CONTROL

[75] Inventors: Bo G. Joelsson, Åby; Mats Idebro, Norrköping, both of Sweden

[73] Assignee: U.S. Philips Corp., New York, N.Y.

[21] Appl. No.: 305,880

[22] Filed: Feb. 2, 1989

[30] Foreign Application Priority Data

Feb. 2, 1988 [SE] Sweden ..... 8800323

[51] Int. Cl.[5] ..... H05B 6/68

[52] U.S. Cl. ..... 219/10.55 B; 219/10.55 C

[58] Field of Search ..... 219/10.55 B, 10.55 R, 219/10.55 C, 492, 497; 328/267, 261; 331/87, 185, 186; 323/305, 364, 901

[56] References Cited

U.S. PATENT DOCUMENTS

| | | | |
|---|---|---|---|
| 3,784,781 | 1/1974 | Foerstner et al. | 219/10.55 B |
| 4,005,370 | 1/1977 | Kusunoki et al. | 328/267 |
| 4,300,032 | 11/1981 | Niu et al. | 219/10.55 B |
| 4,420,668 | 12/1983 | Larson et al. | 219/10.55 B |
| 4,481,393 | 11/1984 | Ueda | 219/10.55 B |
| 4,507,531 | 3/1985 | Teich et al. | 219/10.55 B |
| 4,617,438 | 10/1986 | Nakata | 219/10.55 B |

FOREIGN PATENT DOCUMENTS

| | | |
|---|---|---|
| 0043958 | 1/1982 | European Pat. Off. . |
| 0148085 | 7/1985 | European Pat. Off. . |
| 0239072 | 9/1987 | European Pat. Off. . |
| 2108734 | 5/1983 | United Kingdom . |

*Primary Examiner*—Philip H. Leung

*Attorney, Agent, or Firm*—Emmanuel J. Lobato

[57] ABSTRACT

A microwave oven for heating food, in which power control is by pulsing a microwave source during a sequence of operation periods. The start moment of the microwave source is sensed during each operation period, and the switch on time of the microwave source during each operation period is calculated from the sensed start moment. Start moment related variations in supplied average power level are eliminated.

5 Claims, 3 Drawing Sheets

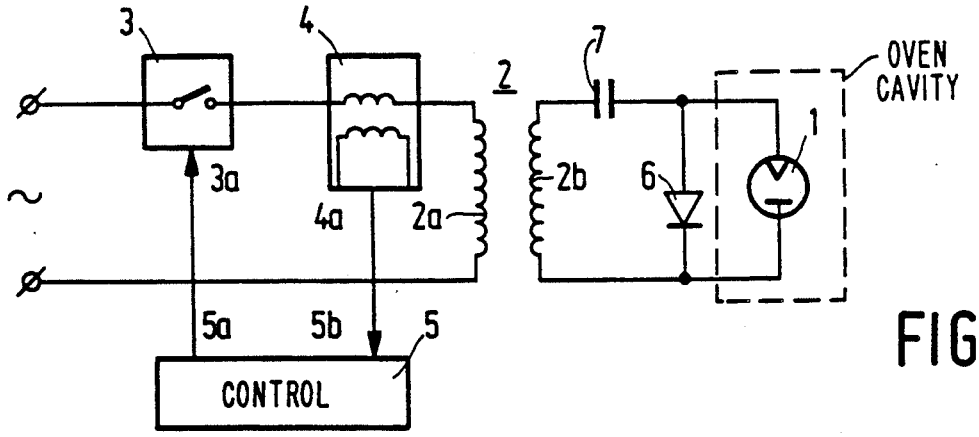
FIG. 1
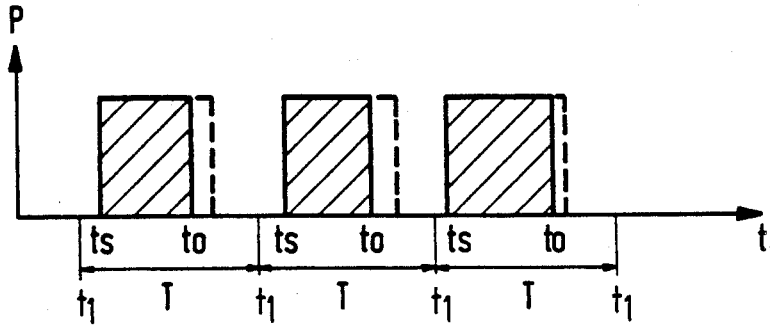
FIG. 2
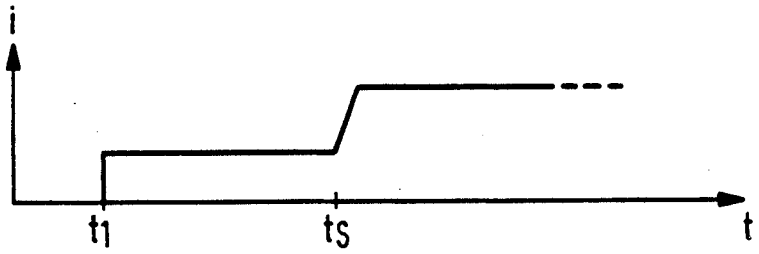
FIG. 3
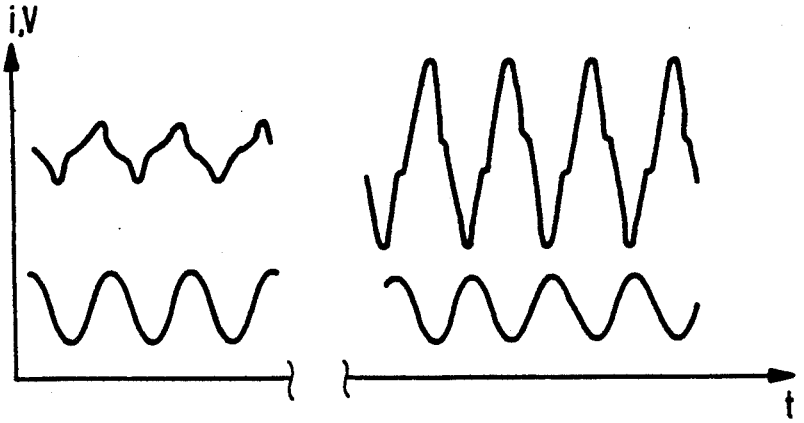
FIG. 4b
FIG. 4a

MICROWAVE OVEN WITH IMPROVED MICROWAVE POWER CONTROL

BACKGROUND OF THE INVENTION

The present invention is directed to a microwave oven for heating food and comprising an oven cavity and a microwave source for generating microwaves in the cavity, and more particularly to a control device for controlling the microwave power in the oven cavity.

Power controlled microwave ovens have been implemented in different ways. GB-A2-108 734 describes a device in which the power supplied to the microwave source, normally a magnetron, is measured and dependent on the measured value the number of mains voltage cycles that are supplied to the power source is varied in order to obtain the desired power. U.S. Pat. No. 4,420,668 is likewise based on power measurement and control of the magnetron operating time dependent thereon. EP-A2-0.043.958 describes another device which is based on power measurement by measuring the current and voltage supplied to the microwave power source. SE 7510018-0 describes a device comprising a power source of the switch mode type, in which the current to the magnetron is measured and in which the measured current value is used for controlling a frequency transformation in the power source to influence the power which is supplied.

The above mentioned power control devices all are based on measurement of power or current. This means that the devices will be relatively demanding with respect to components with a consequent increase in complexity and manufacturing cost.

Another method for power control in microwave ovens is based on control of the magnetron operating time. Normally the magnetron always operates at maximum power and lower power levels are obtained by so-called pulsing of the magnetron. This means that the operating time of the magnetron is subdivided into operation periods and that the magnetron is switched on during parts of the operation period in such a manner that the mean power value during an operation period corresponds to the desired power level. For example, if a fifteen second operation period is used a mean power level corresponding to 60% of the maximum power may be obtained by switching on the magnetron for nine seconds and switching off the same for six seconds during each operation period. This time control is useful also in combination with another control mode such as power control according to the patent specifications discussed above. An example would be time control in combination with a switch mode power source having a controllable output power.

Generally, the components comprising a microwave supply system, e.g. transformer, magnetron, high voltage capacitor, exhibit component tolerances which influence the power supplied. In the case of controlling the duration of power levels which are lower than the maximum power as described above, there are also variations in the time before the magnetron starts generating microwaves, after the generation of a start signal by a control device. The variations of the starting time are influenced by the component tolerances but are in the first instance strongly dependent on the mains current which is supplied to the microwave oven. As a consequence a deviation will arise between the nominally calculated switch-on interval of the magnetron and that which is actually obtained during an operation period and consequently a corresponding deviation will occur in the average power during the operation period.

SUMMARY OF THE INVENTION

One object of the invention is to obtain in a microwave oven a switch-on interval of the microwave source during an operation period that is essentially independent of variations in the moment the magnetron actually starts.

The invention is based on the understanding that in a microwave oven using time control for obtaining power levels lower than the maximum level, typically more than 50% of the power deviation may be referred to the above described variations in the switch-on interval of the magnetron, and that an elimination of the variations will lead to improved power control.

The object of the invention is obtained by a microwave oven comprising means for generating an output signal at the moment that operation of the microwave source starts, said means sensing a physical parameter which changes when the generation of microwave power starts, and said control device is provided to perform a switch off of the microwave source during an operation period dependent on the generated output signal.

The invention provides for an advantageously simple and inexpensive solution because a measured value of the sensed physical parameter is not established but instead only the moment when a change occur. Furthermore, a technical solution of this type is well suited for use in a time controlled power control system as described above, because the switch-on interval of the microwave source during the operation period in a simple manner may be independent of variations of the start moment of the microwave source by being calculated from the measured moment of parameter change.

BRIEF DESCRIPTION OF THE DRAWING

FIG. 1 is a schematic circuit diagram of a microwave supply system according to the invention;

FIG. 2 is a timing diagram illustrating different modes for controlling microwave power;

FIG. 3 is a timing diagram illustrating the mode used for detecting magnetron operation in the present invention;

FIGS. 4*a* and 4*b* are waveform diagrams of voltage and current before and after the start of magnetron operation in the present invention;

DETAILED DESCRIPTION OF THE INVENTION

Figure 5:
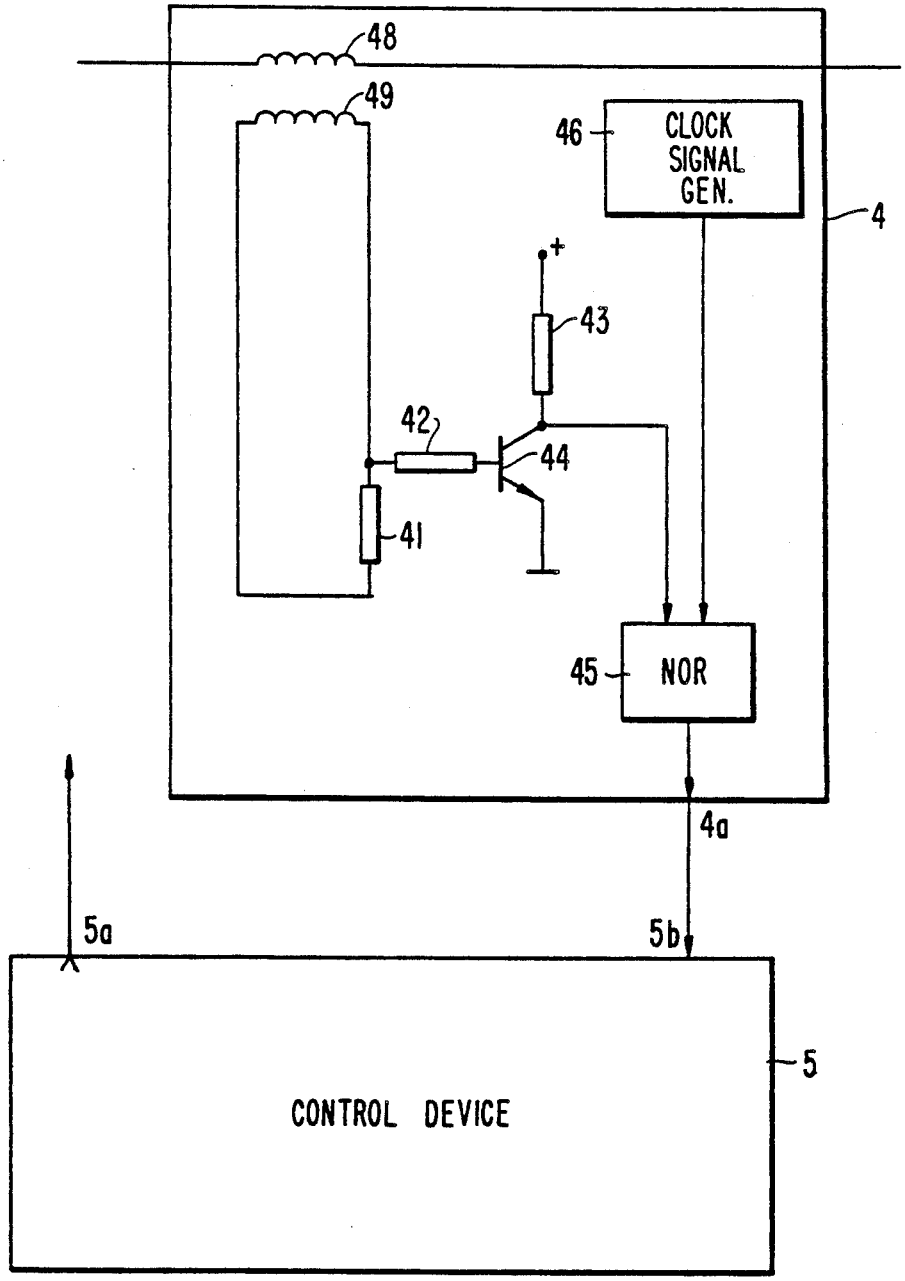
FIG. 5 is a schematic diagram of the current sensor according to the invention.

FIG. 1 shows a microwave supply system of a microwave oven according to the invention. The microwave system comprises a microwave source 1, such as a magnetron. A power transformer 2 has a primary winding 2*a* and a secondary winding 2*b* connected to the magnetron 1. A current switch 3 and a current sensor 4 comprise the primary circuit of the transformer 2. A control device 5 for controlling the microwave power has a control output 5*a* connected to a control input 3*a* of the current switch 3 and a control input 5*b* connected to an output 4*a* of the current sensor 4. A diode 6 and a capacitor 7 comprises the secondary circuit of the transformer 2. Except for the current sensor 4 and the control device 5, the disclosed microwave supply system is known and of a type which is used in microwave ovens available on the market, e.g. Philips type AWM730.

The magnetron 1 is supplied with a rectified high voltage via the transformer 2, the capacitor 7 and the diode 6. The magnetron is switched on and off by the current switch 3, which may comprise a triac or a relay, under control of the control device 5. The operation time of the magnetron 1 is set by means of the control device 5, as is the desired power level. When the power level is below the maximum power the operation time is subdivided into successive operation periods, and the control device 5 takes care of switching the magnetron 1 on and off by closing and opening the current switch 3 during the operation periods. By means of the control device 5 the switch-on interval of the magnetron during each operation period is selected so that the average power during the operation period corresponds to the power level that has been set.

FIG. 2 illustrates the mode of operation. Successive operation periods of duration T are defined. The magnetron starts at different moments $t_s$ during the operation periods, and is switched off according to the prior art at one and the same moment $t_O$ during each period, when a nominal switch-on interval calculated from the beginning of the operation period is reached. Because the start moments $t_s$ vary between the operation periods the microwave power supplied during the operation periods will also vary, which is represented by the differently sized, lined areas.

According to the invention magnetron switch-on is instead calculated from the detected start moment $t_s$ of the magnetron, which brings with it a corresponding displacement of the switch-off moment $t_O$. Consequently, the power contributions during the operation periods will be equal due to the contributions which have been marked with a dashed line, as will be the average power over successive operation periods.

The current sensor shown in FIG. 5 comprises a current transformer having a primary winding 48 in series with the primary winding 2a, and secondary winding 49 connected in series with a first resistor 41. A second resistor 42 is connected in series with one terminal of the resistor 41 and the base terminal of a transistor 44. The emitter of transistor 44 is connected to ground, and the collector thereof is connected to a positive voltage source through a third resistor 43. The collector is connected to a first input of a NOR-gate 45. A clock signal generator 46 supplies a clock signal $f_M$ having the mains frequency, 50 to 60 Hz. The resistance values of resistors 41 and 42 provide a threshold for the current in the secondary winding 49. When the current generates a voltage drop across resistor 41 which makes the base voltage of the transistor equal to 0.7 volts, the transistor 44 becomes conductive. This condition is obtained after magnetron operation starts.

The current sensor mode of operation is illustrated in FIG. 4b. An output signal is generated on output 4a when the absolute values of the secondary current and mains voltage reach maximum. This condition is achieved by phase locking of the clock signal $f_M$ to the maxima of the mains voltage, such that the clock signal goes low at maximum. The current sensor 4 operates as follows. At the start of operation the current in the secondary winding 49 of the current sensor reaches a value which makes transistor 44 conductive. As a result the corresponding input of NOR-gate 45 becomes low. At the following maximum of the mains voltage the clock signal generates a low input signal on the second input of NOR-gate 45, then generating a high level on output 4a, which is supplied to input 5a of the control device 5.

As shown in FIG. 5 the control device 5 comprises a microprocessor μP having an output 5a for switching the switch 3, and in input 5b receiving information from the current sensor 4. The control device 5 is a standard NEC microprocessor type 7516.

An operation period is initiated when the control device 5 generates a control signal which closes the current switch 3. This occurs at the moment $t_1$ in the current-time diagram in FIG. 3. A comparatively small current then flows through the current sensor 4 up to the moment $t_s$, when the magnetron starts and the current jumps and thereafter stabilizes at a comparatively high level. The interval $t_1$–$t_s$ varies greatly, and among other things is dependent on the actual mains voltage. As illustrated in FIG. 2 the influence of the variations on the average power during an operation period is eliminated by calculating the switch-on interval of the magnetron during each operation period from the magnetron start moment $t_s$, which is sensed during each operation period, instead of being calculated from the moment $t_1$ when a control signal is sent from the control device 5 to the current switch 3. From FIG. 3 it is also clear that sensing of the magnetron start is comparatively uncritical because of the great difference in the current level before and after magnetron start. Either the peak value or the RMS-value of the current may be sensed.

Figure 6:
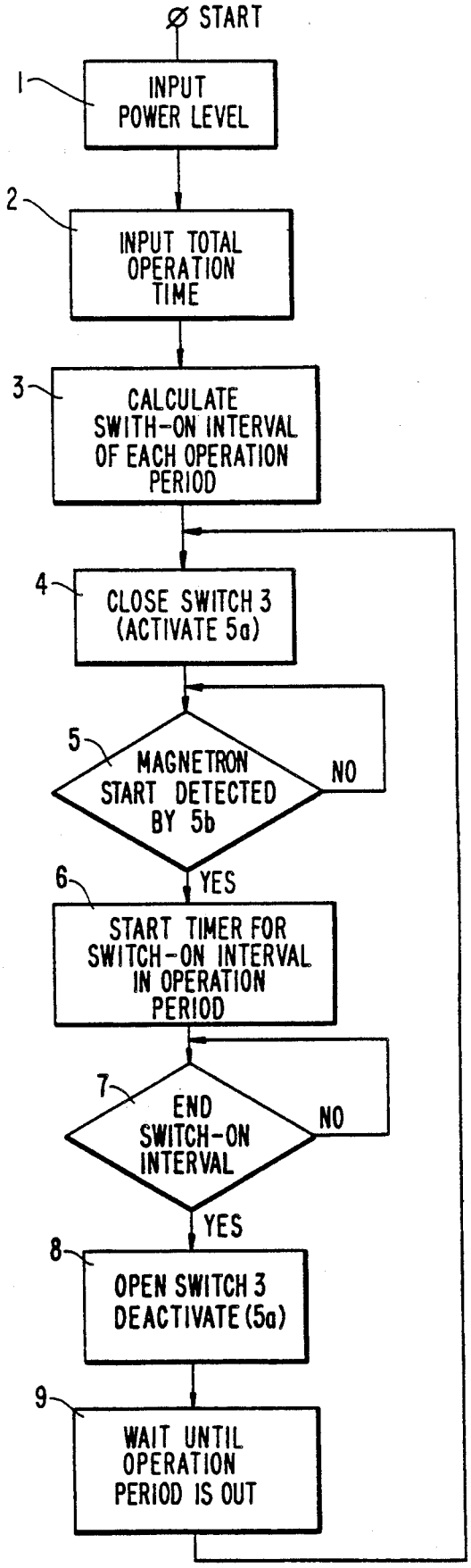
FIG. 6 is a flow chart showing the control sequence of the control device of the invention.

The microprocessor 5 is programmed to operate according to the flow chart disclosed in FIG. 6. In block 1 the microprocessor receives a selected input power level, and in block 2 the selected total operation time. For selected power levels below maximum power the microprocessor subdivides the total operation time into operation periods, and calculates the switch-on interval of each operation period in block 3.

Subsequent blocks 4, 5, 6, 7, 8, 9 illustrate the program steps which are carried out by the microprocessor for each operation period until the total operation time is reached and the oven is switched off. Accordingly, the microprocessor starts an operation period by closing switch 3, which is illustrated in block 4 and is obtained by generating a close-signal on output 5a, which is supplied to input 3a of the switch 3. In block 5 the microprocessor checks if a magnetron start signal has been received from the current sensor 4 on input 5b as described above; if NO the check routine is repeated; if YES the microprocessor proceeds to block 6. In block 6 the microprocessor starts a timer for the calculated switch-on interval in the operation period. In block 7 is checked if the switch-on interval in the operation period is ended; if NO the check is repeated; if YES the program continues to block 8. In block 8 the microprocessor generates an open-signal on output 5a, which is supplied to input 3a of the switch 3 which is then opened. In block 9 the microprocessor waits until the operation period is over. Thereafter a new operation period is started by closing switch 3 according to block 4. This restart of the program at block 4 is repeated until the selected total operation time is over and the oven is switched off.

FIGS. 4a and 4b illustrate alternative ways of sensing the change of current. In FIG. 4a the upper graph shows the current before magnetron start, and the lower graph shows the mains voltage, while the upper graph in FIG. 4*b* shows the current after magnetron start and the lower graph the mains voltage. From FIG. 4*a* it is clear that the current before magnetron start reaches its maximum value at the zero transition of the mains voltage, while FIG. 4*b* shows that the maximum of the absolute value of the current after the magnetron start and the maximum of the mains voltage appear simultaneously. The magnetron start may consequently be detected by a phase comparison between the phase of the current through the primary winding of the transformer 2 and the phase of the mains voltage.

The start moment of the magnetron may alternatively be obtained by sensing any other parameter or magnitude which changes at the start of the magnetron. This may be obtained by sensing the magnetic field in the high voltage transformer 2, e.g. by means of an extra winding in connection with the transformer or the iron core thereof. Alternatively, it is possible to use a magnetic field sensing element, like a Hall element.

According to FIG. 1 the current is sensed in the primary winding of the transformer 2. Alternatively it is possible to sense the current correspondingly in the secondary winding of the transformer 2.

A further possibility to establish the magnetron start is to detect by means of a microwave field sensor the appearance of microwaves in the oven cavity or in the wave guide connection between the magnetron and the oven cavity.

The current sensor 4 comprises a so-called current transformer having its primary winding connected in series with the primary winding of the transformer 2 and its secondary winding connected to the input 5*a* of the control device 5. Alternatively, the current in the primary circuit of the transformer may be sensed by means of a small impedance, e.g. a resistor, and then the current is measured by sensing the voltage across said impedance. A so-called optical coupler may be used to obtain electrical isolation. Since only the change of current is sensed this may be easily obtained by means of a threshold circuit comprised in the sensor 4 or in the control device 5, and the threshold value of which is adjusted to a level which is adequate in comparison with the value of the current before and after start of the magnetron.

In all of these alternative embodiments a magnetron start indicating signal is generated, which is supplied to the control device in correspondence with the embodiment according to FIG. 1 described above.

We claim:

1. In a microwave oven of the type for heating food and having an oven cavity, a microwave source for generating microwaves in the oven cavity, and a power supply for supplying electrical power to operate the microwave source, the improvement comprising:

sensing means for sensing a physical parameter of the electrical power supplied to said microwave source which has a value which changes when the generation of microwave power starts; and control means in said power supply for switching off the electrical power to said microwave source at the end of a time interval measured from the start of microwave power generation indicated by a change in the parameter sensed by said sensing means.

2. In a microwave oven as claimed in claim 1, said microwave source comprises a magnetron switched on during a respective interval within each of a succession of operation periods which provides the desired average power level during the succession of operation periods, and said control means is arranged to switch off the electrical power to said microwave source at the end of each interval during each operation period.

3. In a microwave oven as claimed in claim 1 or 2, said power supply comprises a power transformer, and said sensing means comprises a current sensing coil connected into the primary circuit of said power transformer.

4. In a microwave oven as claimed in claim 1 or 2, said power supply comprises a power transformer, and said sensing means comprises an impedance element connected in series with the primary circuit of said power transformer, and means for sensing a change of voltage across said impedance.

5. In a microwave oven as claimed in claim 1 or 2, said sensing means comprises a device for sensing the change of magnetic field in a power transformer comprising said power source.

* * * * *